US006978481B2

(12) United States Patent
Mordecai et al.

(10) Patent No.: US 6,978,481 B2
(45) Date of Patent: Dec. 27, 2005

(54) LINER SYSTEM FOR A FLAME RESISTANT COAT

(75) Inventors: Mark Mordecai, Hampton, NH (US); Julie Snedeker, Northwood, NH (US); Mike Towle, Pittsfield, NH (US)

(73) Assignee: Globe Manufacturing Co., Pittsfield, NH (US)

( * ) Notice: Subject to any disclaimer, the term of this patent is extended or adjusted under 35 U.S.C. 154(b) by 83 days.

(21) Appl. No.: 10/815,675

(22) Filed: Apr. 2, 2004

(65) Prior Publication Data

US 2005/0223463 A1 Oct. 13, 2005

(51) Int. Cl.[7] ..... A62B 17/00
(52) U.S. Cl. ..... 2/81; 2/97; 2/272
(58) Field of Search ..... 2/97, 272.908, 2/81, 85, 87, 82, 98, 93, 129, 135

(56) References Cited

U.S. PATENT DOCUMENTS 5,406,648 A * 4/1995 Butzer et al. ..... 2/81
5,638,547 A * 6/1997 Hewitt ..... 2/81
5,842,229 A * 12/1998 Snedeker ..... 2/98
5,860,163 A * 1/1999 Aldridge ..... 2/81
6,038,700 A * 3/2000 Aldridge et al. ..... 2/81
6,243,872 B1 * 6/2001 Snedeker ..... 2/81
6,687,913 B2 * 2/2004 Aldridge ..... 2/81

* cited by examiner

*Primary Examiner*—John J. Calvert
*Assistant Examiner*—Andrew W. Sutton
(74) *Attorney, Agent, or Firm*—Dykema Gossett PLLC

(57) ABSTRACT

A liner system for a flame resistant coat includes a thermal barrier and a moisture barrier, the upper portion of the thermal barrier being detachably connected to the inner part of the collar of the coat, while the upper portion of the moisture barrier is detachably connected to the outer part of the collar. The upper portions of the thermal barrier and moisture barrier are free of one another; and the upper portion of the moisture barrier extends into the collar a substantial distance above the upper edge portion of the thermal barrier when the collar is in vertical position.

20 Claims, 3 Drawing Sheets

LINER SYSTEM FOR A FLAME RESISTANT COAT

BACKGROUND OF THE INVENTION

The present invention relates to a liner system incorporated into a flame resistant coat as used by firefighters as well as rescue and emergency services personnel. Such coats include an outer shell having a body portion, sleeve portions and a collar portion. It is necessary to ensure that water-tight integrity is maintained at the juncture of the outer shell and the collar portion thereof to prevent the personnel using the coat from getting wet when fighting fires where large amounts of water may splash onto the coat.

The liner system includes an outer moisture barrier and an inner thermal barrier which are conventionally stitched together such that they cannot be readily separated from one another when one of the barriers is damaged and needs to be replaced. As a result, when one of the barriers is damaged, the entire liner may be thrown away. Accordingly, an object of the invention is to provide a construction wherein the two barriers may be readily detached from one another to replace one of the barriers with a new one which in turn can be readily attached to the other original barrier.

When the liner system is wet, either from use in a fire environment or from being laundered, it is necessary to thoroughly dry the liner, and accordingly another object of the invention is to provide an arrangement which allows air to circulate between the barriers in a superior manner to reduce drying time.

When the liner is removed from the coat to launder the liner, it is desirable to prevent contaminates from entering the space between the barriers and to protect the moisture barrier substrate from abrasion as a result of coming into contact the hooks on the fastening portion carried by the moisture barrier.

SUMMARY OF THE INVENTION

The invention coat includes a flame resistant shell forming a body portion having sleeve portions and a collar portion. The collar portion has an inner collar part facing the neck of a person wearing the coat when the collar is in an upright position. The collar portion also includes an opposite outer collar part. The liner comprises a thermal barrier and a moisture barrier. Hook and loop structures detachably connect the upper portion of the moisture barrier to the outer collar part. The moisture barrier extends a substantial distance above the thermal barrier when the collar is in vertical position. The upper portions of the thermal barrier and the moisture barrier are free of one another. The opposite side portions of the two barriers are detachably connected to one another by snap fasteners at spaced points along the length thereof, and the side portions of the thermal barrier are detachably connected by snap fasteners to the body portion of the coat. The lower portions of the thermal barrier and the moisture barrier are stitched to one another along a part of the lower portions by a single line of stitching which may be readily manually removed to separate the two barriers from one another along their lower portions. The lower portions of the thermal barrier and the moisture barrier are also detachably connected to one another at spaced points along another part of the lower portions. The lower portions of the barriers are free of the body portion of the coat.

With this arrangement, the two barriers may be separated from one another to provide separate entities except for the stitched connection at the outer ends of the sleeves of the barriers to one another and to associated wristers. This last-mentioned stitched connection can be removed by conventional machines. In this way, either of the barriers which may be damaged may be disconnected from the other and replaced with a new barrier, whereupon the new and old barriers may be connected to one another and cooperating wristers.

The spacing defined between the upper portions of the barriers as well as the open areas between the spaced points at which the side portions and lower portions of the barriers are detachably connected enables air to circulate between the two barriers when drying after use or after laundering, thereby reducing the drying time.

The fastening means on the upper portions of the two barriers comprise hooks on the moisture barrier which can engage loops on the thermal barrier after the liner is removed from the coat in preparation for laundering the liner. When the upper portions of the barriers are so connected the entry of contaminates between the barriers is prevented, and the hook portions are prevented from contacting the moisture barrier substrate and causing abrasion thereof.

DESCRIPTION OF THE PREFERRED EMBODIMENT

Figure 1:
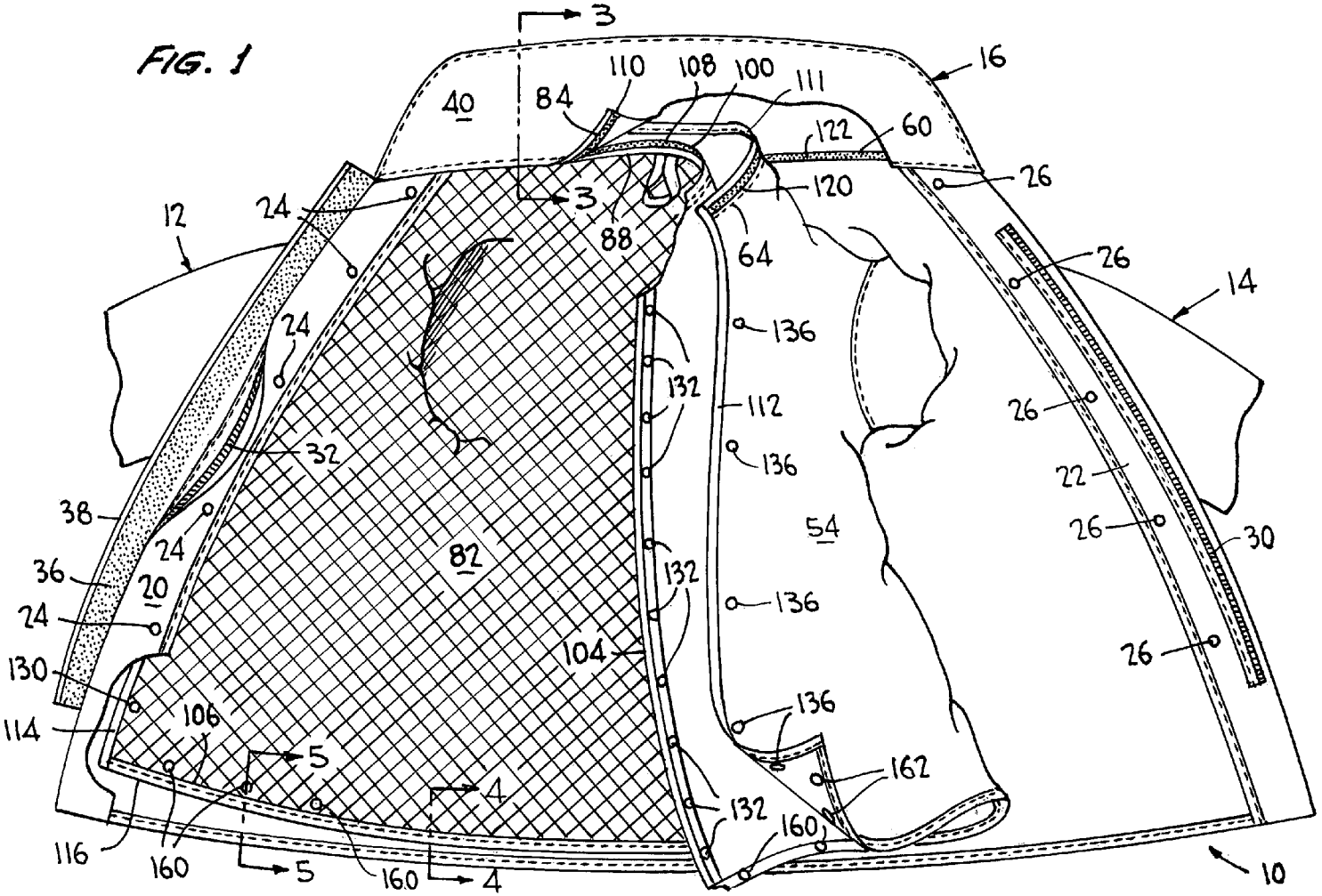
FIG. 1 is a front view of a coat according to the invention in opened position with the collar partly broken away and one facing of the coat folded over to show details of construction, and further with the two barriers of the liner folded back and separated from one another at one side of the liner.

Referring to the drawings wherein like reference characters designate corresponding parts throughout the several views, there is shown in FIG. 1 a coat having a shell formed of conventional flame resistant material which comprises a body or torso portion 10 having stitched thereto a right sleeve 12 and a left sleeve 14. A collar portion 16 is also stitched to the body portion.

The body portion includes a pair of face portions 20 and 22 disposed at the opposite front edges of the body portion. A plurality of spaced conventional snap fasteners 24 are mounted on face portion 20, and a further plurality of spaced conventional fasteners 26 are mounted on face portion 22. These fasteners cooperate with cooperating fasteners mounted on the liner as hereinafter described.

A conventional zipper part 30 is mounted on facing portion 22, and a cooperating zipper part 32 is mounted on the inwardly facing side of facing portion 20 as can be seen in the folded over part of the facing portion. The cooperating zipper parts serve as a closure to hold the coat in closed position in the usual manner. The closure may also be of other conventional constructions such as different variations of hook and D-ring or VELCRO closures if desired. A first part 36 of a hook and loop connection such as VELCRO is mounted on a flap 38 of the body portion, and a cooperating part of the hook and loop connection (not shown) is mounted on the opposite side of facing portion 22 so that the two parts of the hook and loop connection are in contact with one another when the coat is in closed position with flap 38 disposed in overlying relationship to the opposite side of facing portion 24 to provide additional means for holding the coat in closed position and preventing the entry of water or contaminates at the front of the coat.

Figure 3:
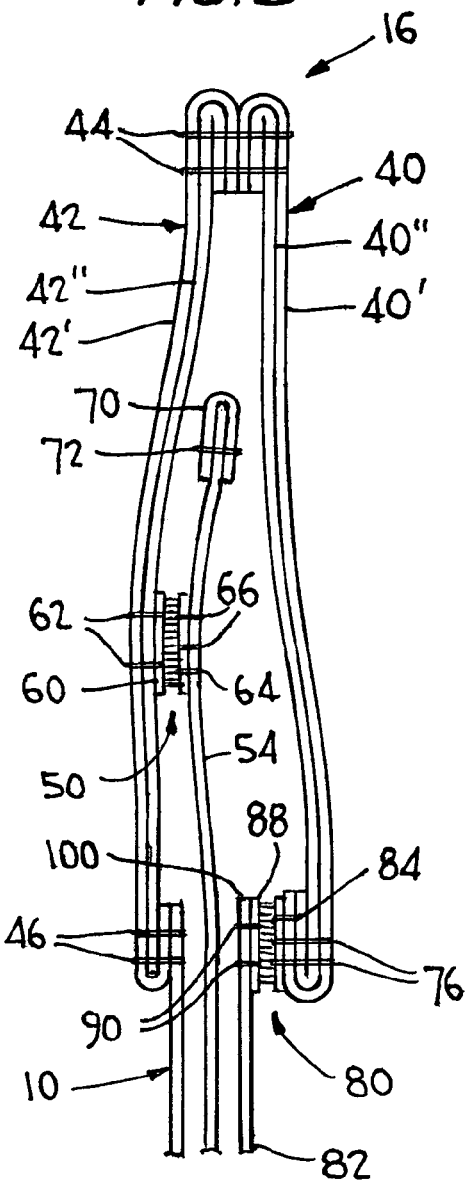
FIG. 3 is a sectional view taken along line 3—3 of FIG. 1.

Referring to FIG. 3, collar portion 16 includes an inner collar part 40 and an outer collar part 42. The inner collar part is formed by a double layer of flame resistant material 40' and 40", while the outer collar part is formed by a similar double layer 42' and 42". The upper ends of layers 40', 40", 42' and 42" are turned over and stitched to one another by stitching 44. The lower ends of layers 42' and 42" are turned over and stitched to body portion 10 by stitching 46.

A fastening means is indicated generally by arrow 50 and comprises means for detachably fastening an upper portion of moisture barrier 54 to the outer part of the collar portion. The fastening means is a hook and loop mechanism such as VELCRO which includes a first loop part supported on strip 60 which is mounted on the face of layer 42" by stitching 62. The second hook part of fastening means 50 is supported on strip 64 which is mounted on the face of moisture barrier 54 by stitching 66. The moisture barrier material is conventional and comprises a breathable moisture barrier fabric having a waterproof surface facing outwardly toward the outer collar part 42. The upper edge portion of the moisture barrier has a binding strip 70 defining a U-shaped cross-section wrapped therearound and held in position by stitching 72.

The lower ends of layers 40' and 40" are turned over and held in place by stitching 76. A fastening means is indicated generally by arrow 80 and comprises means for detachably connecting the upper edge portion of thermal barrier 82 to the inner part 40 of the collar portion. This fastening means is also a hook and loop mechanism such as VELCRO which includes a first hook part supported on strip 84 which is mounted on the face of layer 40 by stitching 76. The second loop part of fastening means 80 is supported on strip 88 which is mounted on the face of thermal barrier 80 by stitching 90. The moisture barrier material is formed of the usual quilted thermal insulating material.

Figure 2:
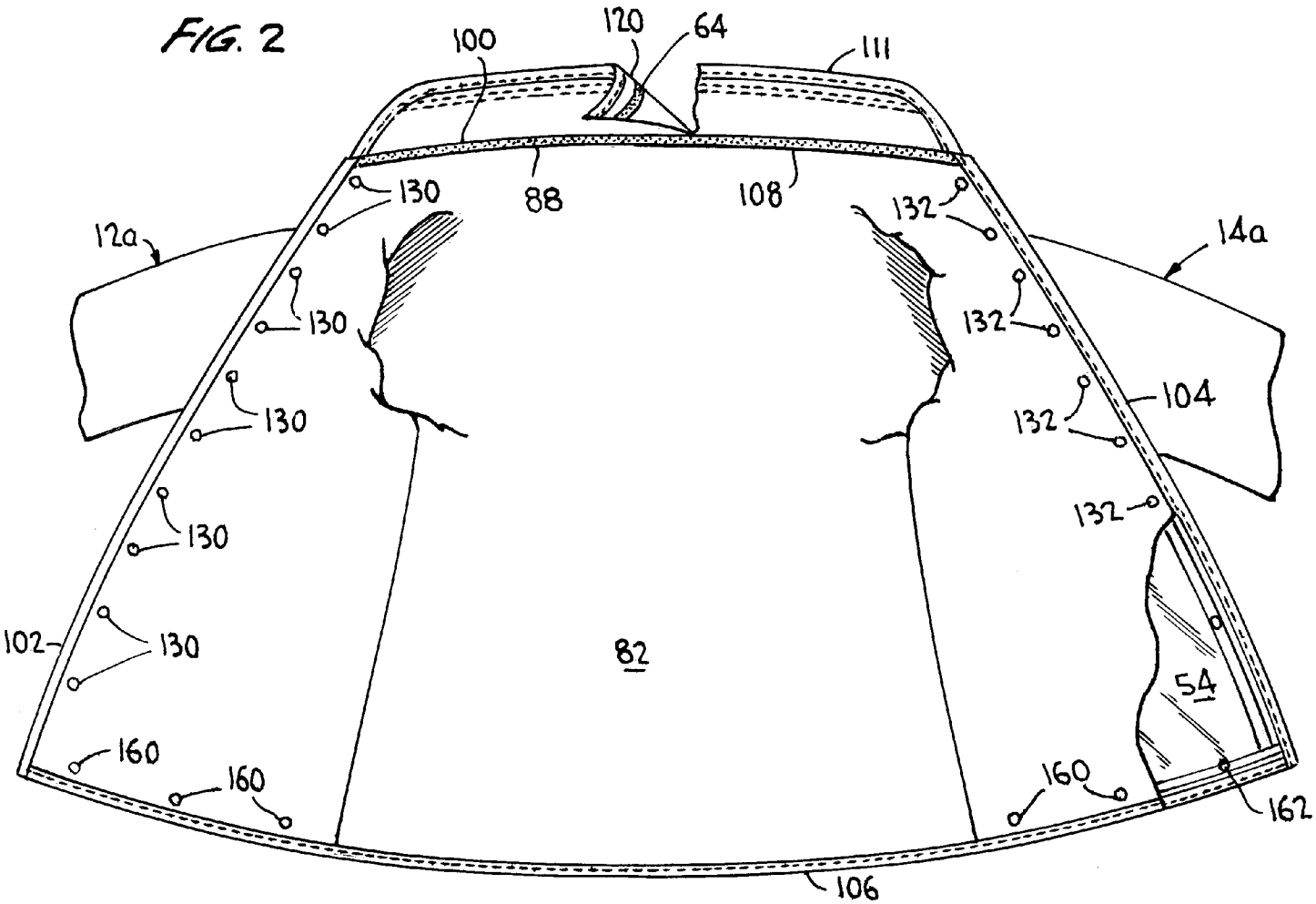
FIG. 2 is a front view, partially broken away, of the liner of the invention with a portion folded to show the opposite side thereof.

Referring now to FIGS. 1–3, thermal barrier 82 has an upper edge portion 100, a pair of opposite side edge portions 102 and 104 and a bottom edge portion 106. Strip 88 extends along the length of the upper edge portion 100 and supports the hook parts 108 of fastening means 80. Strip 84 extends along the length of the lower portion of the inner part 40 of the collar portion and supports the loop parts 110 of fastening means 80.

Moisture barrier 54 has an upper edge portion 111, a pair of opposite side edge portions 112 and 114 and a bottom edge portion 116. Strip 64 extends from side edge portion 112 to side edge portion 114 and is adjacent to and spaced below the upper edge portion as seen in FIGS. 1–3. Strip 64 supports the hook parts 120 of fastening means 50. Strip 60 mounted on the outer part of the collar portion supports the loop parts 122 of fastening means 50. The sleeve portions 12*a* and 14*a* of the moisture barrier are partially shown in FIG. 2.

As seen in FIG. 2, 10 conventional snap fasteners 130 are mounted on thermal barrier 82 along the side edge portion 102, and 10 similar fasteners 132 are mounted on the thermal barrier along the side edge portion 104. As seen in FIG. 1, moisture barrier 54 has five snap fasteners 136 mounted thereon along the side edge portion 112. Five more similar fasteners (not shown) are mounted on moisture barrier 54 along the opposite side edge portion 114 of the moisture barrier.

The top fastener 130 on the thermal barrier connects to the top fastener 24 on facing 20 to detachably connect the thermal barrier to the body portion of the shell. The fastener below the top fastener 130 connects to the upper fastener on the side edge portion 114 of the moisture barrier to detachably connect the moisture barrier to the thermal barrier. This arrangement repeats itself with five alternate fasteners 130 being connected to the facing of the coat and another five alternate fasteners 130 being connected to the moisture barrier. A similar arrangement exists between fasteners 26 on facing 22, fasteners 132 on the thermal barrier and fasteners 136 on the moisture barrier. In this manner, the side edge portions of the thermal barrier and the moisture barrier are detachably connected to one another, and the thermal barrier is detachably connected to the body portion of the coat.

Figure 4:
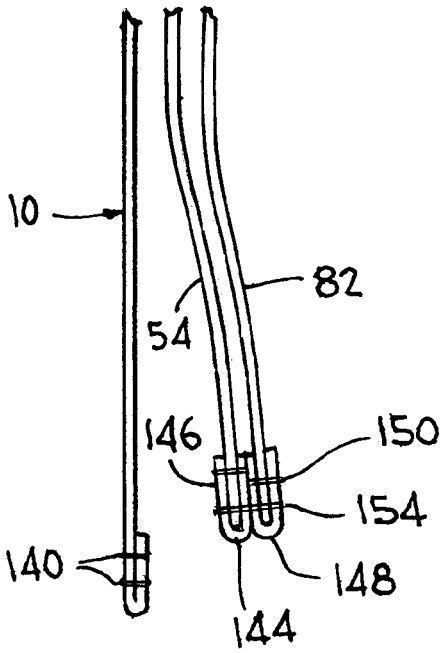
FIG. 4 is a sectional view taken along line 4—4 of FIG. 1.

As seen in FIG. 4, the bottom of the body portion of the shell is turned up and secured by stitching 140 to define a lower edge portion 142. The lower edge portion of the moisture barrier 54 has a binding strip 144 wrapped therearound and secured in position by stitching 146. The lower edge portion of the thermal barrier 82 has a binding strip 148 therearound and secured in position by stitching 150. A single line of stitching 154 passes through each of the layers of material to connect the lower edge portions of the barriers to one another. Line of stitching 154 can be readily manually removed when desired. Therefore, the lower edge portions of the thermal barrier and moisture barrier are stitched to one another in such a manner that they can be readily disconnected from one another. Stitching 154 connects the lower edge portions of the barriers along a central portion of the lower edge portions thereof. In a typical example, these lower edge portions may be stitched together along a length of about eighteen inches of the lower edge portions.

Figure 5:
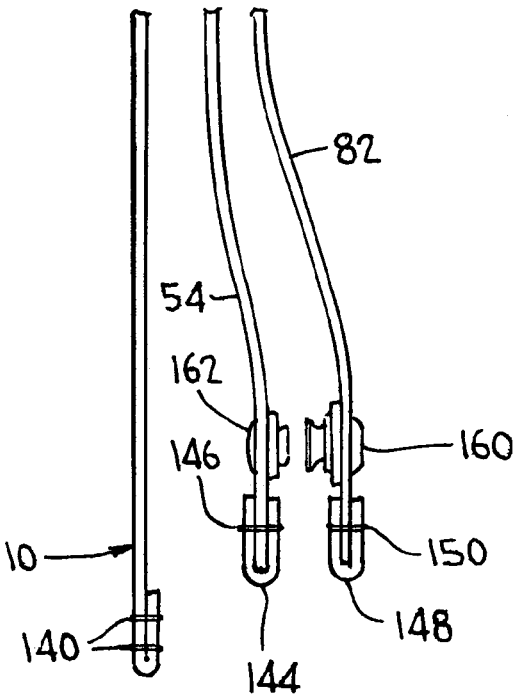
FIG. 5 is a sectional view taken along line 5—5 of FIG. 1.

Referring to FIGS. 1, 2 and 5, the lower edge portions of moisture barrier 54 and thermal barrier 82 are detachably connected to one another along the length of the lower edge portions thereof on either side of the part of the lower edge portions which are stitched to one another as discussed above. The barriers are detachably connected at opposite ends of the lower edge portions thereof by a first plurality of snap fasteners 160 mounted on the thermal barrier and a second plurality of cooperating snap fasteners 162 mounted on the moisture barrier. It is noted that there are three pairs of snap fasteners disposed at either side of the central stitched parts of the lower edge portions of the barriers.

The invention has been described with reference to a preferred embodiment. Obviously, various modifications, alterations and other edbokiments will occur to others upon reading and understanding this specification. It is our intention to include all such modifications, alterations, and alternate embodiments insofar as they come within the scope of the appended claims or the equivalent thereof.

What is claimed is:

1. A liner system for a flame resistant coat, said coat comprising a flame resistant shell including a body portion having left and right sleeve portions, a collar portion including an outer collar part and an inner collar part, said outer collar part being connected to said body portion and to said inner collar part, a liner including a thermal barrier and a moisture barrier, said thermal barrier having an upper edge portion, first fastening means for detachably connecting said upper edge portion of the thermal barrier to said inner collar part, said moisture barrier extending into said collar portion between said inner and outer collar portions, and second fastening means for detachably connecting an upper part of said moisture barrier to said outer collar part, said thermal barrier being free of said upper part of said moisture barrier.

2. A liner system as defined in claim 1 wherein said first fastening means includes a first fastening portion supported by said upper edge portion of the thermal barrier and a cooperating second fastening portion supported by said inner collar part.

3. A liner system as defined in claim 1 wherein said second fastening means includes a third fastening portion supported by an upper part of the moisture barrier and a cooperating fourth fastening portion supported by said outer collar part.

4. A liner system as defined in claim 1 wherein said moisture barrier extends a substantial distance above said upper edge portion of the thermal barrier when the collar is in an upright position.

5. A liner system as defined in claim 1 wherein said thermal barrier and said moisture barrier each have opposite side edge portions and lower edge portions, the side edge portions of the thermal barrier and moisture barrier being detachably connected to one another.

6. A liner system as defined in claim 5 wherein the side edge portions of the thermal barrier and the moisture barrier are detachably connected to one another at spaced points along corresponding sides thereof.

7. A liner system as defined in claim 5 wherein said side edge portions of the thermal barrier are detachably connected to said body portion.

8. A liner system as defined in claim 7 wherein said side edge portions of the thermal barrier are detachably connected to said body portion at spaced points along the length of said side edge portions.

9. A liner system as defined in claim 5 wherein at least a part of the lower edge portions of the thermal barrier and moisture barrier are stitched to one another in such a manner that they can be readily disconnected from one another.

10. A liner system as defined in claim 9 wherein another part of the lower edge portions of the thermal barrier and moisture barrier are detachably connected to one another.

11. A liner system as defined in claim 9 wherein said lower edge portions of the thermal barrier and moisture barrier are free of said body portion of the shell.

12. A liner system for a flame resistant coat, said coat comprising, a flame resistant shell including a body portion having left and right sleeve portions and having a collar portion connected to said body portion, said liner system including a thermal barrier and a moisture barrier, each of said barriers having an upper portion, a lower portion and a pair of opposite side portions, said opposite side portions of the thermal barrier and the moisture barrier being detachably connected to one another, the upper portions of the thermal barrier and the moisture barrier being free of one another, and means for detachably connecting said upper portions of the moisture barrier and thermal barrier to different areas of the collar portion.

13. A liner system as defined in claim 12 wherein said collar portion includes an inner collar part detachably connected to said thermal barrier and an outer collar part detachably connected to said moisture barrier.

14. A liner system as defined in claim 12 wherein the side portions of the thermal barrier and the moisture barrier are detachably connected to one another at spaced points along corresponding sides thereof.

15. A liner system as defined in claim 12 wherein a part of the lower portions of the thermal barrier and the moisture barrier are stitched to one another in such a manner that they can be readily disconnected from one another.

16. A liner system as defined in claim 15 wherein the lower portions of the thermal barrier and moisture barrier each have a binding strip wrapped around the lower edges thereof, and a single line of readily removable stitching extends through the binding strips and the barriers.

17. A liner system as defined in claim 15 wherein another part of the lower portions of the thermal barrier and moisture barrier are detachably connected to one another.

18. A liner system as defined in claim 12 wherein said lower portions of the thermal barrier and moisture barrier are free of said body portion of the shell.

19. A liner system as defined in claim 12 wherein said side portions of the thermal barrier are detachably connected to said body portion.

20. A liner system as defined in claim 19 wherein said side portions of the thermal barrier and moisture barrier are detachably connected to said body portion at spaced points along the length of said side portions.

* * * * *